United States Patent [19]

Reinke et al.

[11] 4,249,724

[45] Feb. 10, 1981

[54] APPARATUS FOR TEMPERING THE SURFACES OF MUTUALLY DISPLACED CAMS OF A CAST-IRON CAMSHAFT

[75] Inventors: Friedhelm Reinke; Edgar Stengel, both of Remscheid, Fed. Rep. of Germany

[73] Assignee: AEG-Elotherm, G.m.b.H., Remscheid, Fed. Rep. of Germany

[21] Appl. No.: 79,562

[22] Filed: Sep. 27, 1979

[30] Foreign Application Priority Data

Dec. 14, 1978 [DE] Fed. Rep. of Germany ..... 2853964

[51] Int. Cl.[3] ..... C21D 1/08

[52] U.S. Cl. ..... 266/261

[58] Field of Search ..... 266/249, 261

[56] References Cited

U.S. PATENT DOCUMENTS 4,147,335 4/1979 Heck ..... 266/261

*Primary Examiner*—R. Dean

*Attorney, Agent, or Firm*—Cushman, Darby & Cushman

[57] ABSTRACT

An apparatus for tempering the surfaces of mutually displaced cams of a cast-iron camshaft in which heat energy sources are movably disposed at a distance from each cam. The apparatus holds the camshaft to be tempered in a vertical orientation for rotation about its axis and the heat sources are positioned about the camshaft axis at relative angles of rotation equal to the relative angles of rotation of the corresponding cams so that the cams may be heated simultaneously and syncronously with the rotation of the camshaft.

1 Claim, 2 Drawing Figures

APPARATUS FOR TEMPERING THE SURFACES OF MUTUALLY DISPLACED CAMS OF A CAST-IRON CAMSHAFT

BACKGROUND AND SUMMARY OF THE INVENTION

The invention relates to an apparatus for tempering the surfaces of mutually displaced cams of a cast-iron camshaft. More particularly, the invention relates to such an apparatus in which a camshaft may be rotatably mounted with energy sources disposed movably at the periphery of the camshaft at a distance from the cam axis acting against the surfaces of the cams for the preferably punctiform fusing on the surfaces. A master camshaft is rotatably mounted by way of means for synchronously driving the master camshaft and the camshaft to be tempered. Control cams scan the surface of the master cams for the adjustment of the distance of the energy sources from the cam axis. The camshaft is also mounted so as to be movable in its rotational mounting in the direction of the camshaft axis.

In a known apparatus (cf., for example, U.S. Pat. No. 4,147,335) the camshaft is mounted horizontally and the energy sources are shielded arc welding torches which are disposed above a horizontal plane through the rotational axis of the camshaft at a distance from the rotational axis of said camshaft. The torches are controlled by way of gearing by the master camshaft in regard to its distance from the cams in such a way that the distance to the surface of the pertinent cam is constant independently of the shape of the cam. At the same time, it turned out to be effective to dispose the torches around the camshaft axis inclined toward the horizontal plane. The inclination corresponds to about 50° and is to ensure that the liquid metal would not drip off the surface of the cam.

Such apparatuses have the disadvantage that the individual cams, because of the pertinent angular displacement of said cams, may not be fused-on synchronously. Rather, the individual torches are fired by way of cam switches coupled with the drive of the camshafts whenever the area of a cam which has to be tempered enters into the vicinity of the torch. This method of operation also leads to a prolongation of the force stroke, since the individual cams must be fused-on mutually displaced in time.

The invention deals with an improvement of apparatuses of the type designated in more detail above with which a reduction of the force stroke may be achieved. According to the invention, this improvement will be achieved by disposing the camshaft in its support essentially in a perpendicular axial position disposing the energy sources distributed around the longitudinal axis of the camshaft, mutually disposed at angular distances corresponding to the relative angular displacements of the cams. In this arrangement, the cam surfaces of the individual cams can be fused-on in a synchronously running force stroke.

BRIEF DESCRIPTION OF THE DRAWINGS

Further advantages and details of the present invention will be apparent from the following detailed description of a preferred embodiment and accompanying drawings.

DETAILED DESCRIPTION OF THE PREFERRED EMBODIMENT

Figure 1:
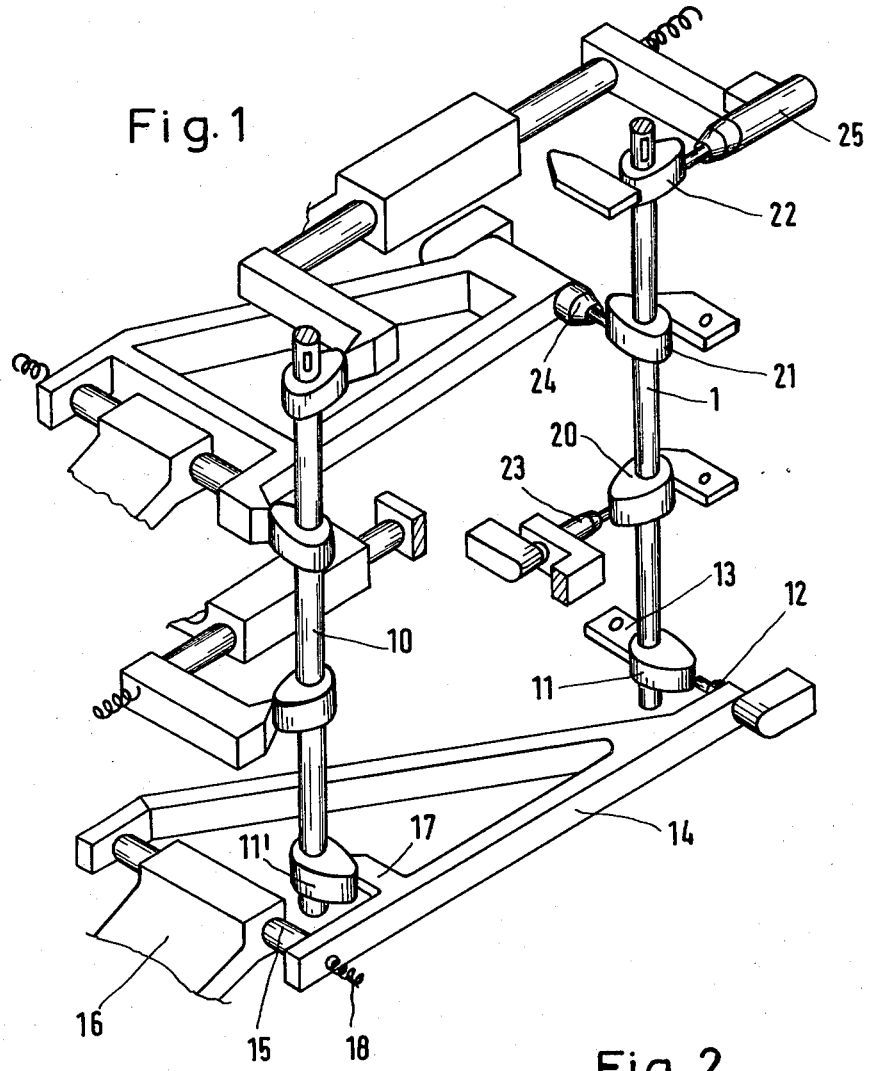
FIG. 1 shows a first upper part of the apparatus according to the invention in a perspective, lateral view with portions removed for clarity.

In the drawing, the reference number 1 designates a cast-iron camshaft mounted in a vertical position. Camshaft 1 is introduced into a bearing 2 by way of a transporting mechanism (not shown) suspended, from above, so that it may rotate about its longitudinal vertical axis. The bearing 2 is disposed in an abutment fixed on bearing plate 3 and may be driven by means of a driving motor 4 by way of a chain drive 5. A control cam disc 6 is connected with the bearing 2, which disc produces electric control pulses at the output of an electric scanning apparatus 8 via a control cam 7 during the passage of the control cam 7 through said apparatus 8. These control pulses are used for the position-dependent control of operating processes.

A bearing 9 is connected with the driving motor 4 into which a master camshaft 10 is inserted. The master camshaft 10 is developed similarly to the camshaft 1 in a vertical orientation and is disposed at a distance from said camshaft 1. It rotates synchronously with the camshaft 1.

For tempering the surfaces of cam 11 of the camshaft 1, an electric arc torch 12 has been provided which is disposed at a distance from the cam 11. It is adjustable in its distance from the longitudinal axis of the camshaft 1 and is measured by an electric counter-contact 13, which slides on the surface of the cam 11 and serves for the conduction of the electric current.

The torch 12 is mounted on a frame 14 which is fixed to a bearing rod 15 slidably mounted in a counter-bearing 16 fixed in the machine. The frame 14 carries a control cam 17 which scans the surface of a cam 11' of the master camshaft 10 and which, at the same time, adjusts the frame 14 counter to the effective force of the spring 18 in a longitudinal direction of the rod 15, and which thus preserves the distance of the torch 12 from the surface of the cam 11 independently of the rotation of the cam.

Figure 2:
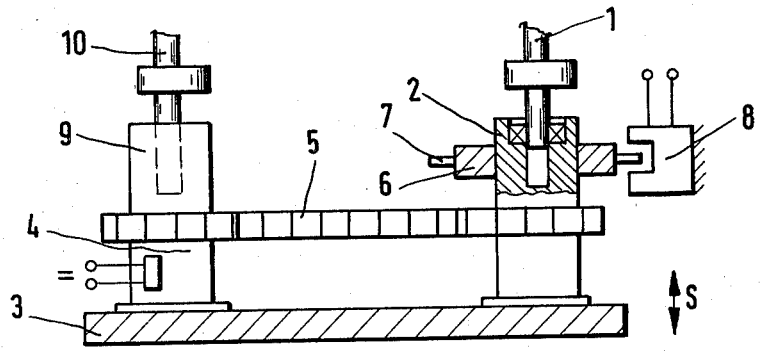
FIG. 2 shows a second lower part of the apparatus according to FIG. 1 with portions broken away removed for clarity.

Since the torch 12 produces an essentially punctiform fusing spot on the surface of the cam 11, the bearing plate 3—cf. FIG. 2—is mounted so that it is movable by strokes in the direction of the longitudinal axes of the cam-shafts and guides the arc of the torch in an oscillating manner over the surface of the cam 11.

In order to fuse-on the cams 20, 21 and 22, arc torches 23, 24 and 25 have been provided which are disposed, displaced angularly with respect to the arc torch 12 at angles corresponding to the displacement of the cams. Their distance from the corresponding cams of camshaft 12 are controlled by way of the pertinent master cams of the master camshaft 10.

The individual electric arc torches are fired synchronously by way of the control mechanism 6, 7, 8 so that the individual cams are processed synchronously. At the same time, the torches are guided over the surface of the individual cams synchronously with the rotation of the camshaft 1 and in correspondence with the stroke of the bearing plate 3, whereby the surfaces are fused on, up to a predetermined depth and solidify subsequently with a corresponding ledeburitic textured structure.

Because of the vertical position of the surfaces that are to be fused on, the rpm of the camshaft and the fusing-on performance of the individual torches is to be dimensioned in such a way that the fused-on camshaft material does not drip off the perpendicularly positioned surfaces.

What is claimed is:

1. In an apparatus for tempering the surfaces of cams mutually angularly and longitudinally displaced along the longitudinal axis of a cast-iron camshaft, said apparatus including means for mounting the camshaft to be tempered for rotation about its axis of rotation, for fusing-on of the surface of said cams, a plurality of energy sources, each energy source corresponding to one of said cams, each energy source respectively disposed at the periphery of said camshaft to be tempered and movable toward and away from the surfaces of said corresponding cam, a master camshaft having master cams, drive means for synchronously rotating said master camshaft and said camshaft to be tempered in parallel spaced relation, means, scanning the surfaces of said master cams, for adjusting the distance of the energy sources from said axis of rotation, and means for moving said camshaft to be tempered in the direction defined along said axis of rotation, the improvement comprising means for supporting said camshaft to be tempered in a vertical orientation, said energy sources being respectively disposed at angular distance relative to one another corresponding to the angular displacements of said cams of said camshaft to be tempered relative to one another.

* * * * *